United States Patent [19]

Chuang

[11] Patent Number: 4,825,562

[45] Date of Patent: May 2, 1989

[54] SHOES USED FOR SNOW AND SLIP-PROOF

[76] Inventor: Shoon-Tsair Chuang, No. 14-34, Tain-Fur Rd., San-Shiar Jehn, Taipei, Hsien, ROC, Taiwan

[21] Appl. No.: 146,233

[22] Filed: Jan. 20, 1988

[51] Int. Cl.[4] ..... A43C 15/00; A43C 15/08

[52] U.S. Cl. ..... 36/61; 36/134

[58] Field of Search ..... 36/134, 127, 61, 59 R

[56] References Cited

U.S. PATENT DOCUMENTS

| | | | |
|---|---|---|---|
| 3,793,751 | 2/1974 | Gordos | 36/61 |
| 4,375,729 | 3/1983 | Buchanen III | 36/61 |

FOREIGN PATENT DOCUMENTS

| | | | |
|---|---|---|---|
| 1965198 | 8/1971 | Fed. Rep. of Germany | 36/61 |
| 2008088 | 8/1971 | Fed. Rep. of Germany | 36/61 |

*Primary Examiner*—James Kee Chi

*Attorney, Agent, or Firm*—Bucknam and Archer

[57] ABSTRACT

Shoes with two sets of elastic nails on the sole are provided. When one wants to walk on snowy ground or ice, a key may be used to allow the two sets of nails to project from the sole to prevent sliding. If he wants to walk on the ground without snow or in a room, the key may be turned off and then the nail sets retract into the sole. This result is achieved by means of a structure which comprises a box with the shape similar to the sole. The box is installed between the insole and the sole. The box includes the body, a switching device, a moving board, two nail sets and a sole cover. When the switching device is turned, the moving board moves straight. The thicker part of the moving board to be inserted into the upper part of the nail set forces the nail set to project from the hole on the sole to constitute a pair of sliding-proof shoes. On the contrary, when the switching device is reversed, the nail set retracts into the sole so that a pair of common shoes results.

3 Claims, 2 Drawing Sheets

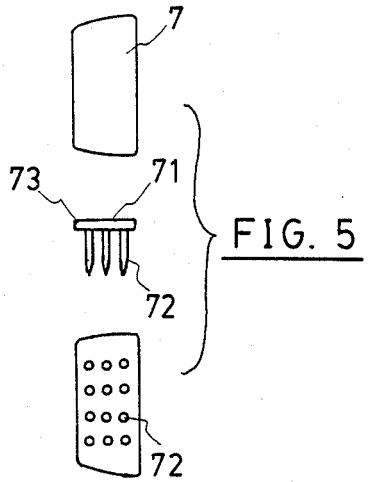
FIG. 5
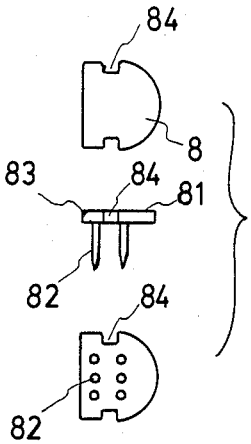
FIG. 6
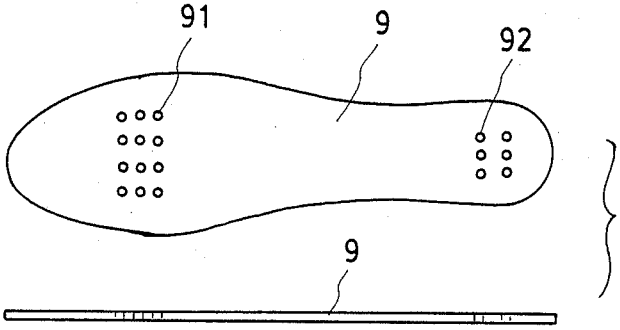
FIG. 7
FIG. 8
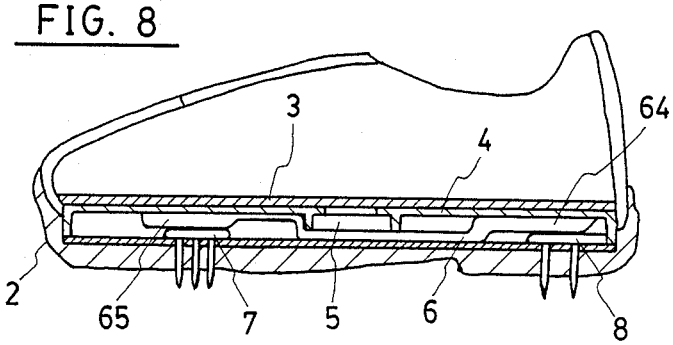

SHOES USED FOR SNOW AND SLIP-PROOF

FIELD OF THE INVENTION

This invention provides shoes with two sets of elastic nails on the sole. When one wants to walk on snowy ground or ice, a key may be used to allow the two sets of nails to project from the sole to prevent sliding. If one wants to walk on the ground without snow or inside a room, the key may be turned off and then the nail sets retract into the sole so that a pair of common shoes results.

BACKGROUND OF THE INVENTION

Most of the conventional skating shoes are to be used on snowy ground or ice only. Due to the narrow range of application on cold regions, they may not be used extensively in regions with different weather; under these circumstances, the shoes with nail sets have been introduced to meet the requirement of dual purposes, that is, they may be used either on ice and snowy ground or for other purposes. In view of the fact that this kind of shoes with dual purposes requires tools and fittings for assembling and dismantling based on the experience in the production and export of shoes for many years, the inventor has devoted himself to the invention of dual purpose shoes.

SUMMARY OF THE INVENTION

The shoes of this invention have a special structure in the soles, the structure is to allow the nail set projecting or retracting back; the shoes may be used for dual purposes without requiring additional fittings or tools. The delicate design of the structure ensures steady fastening and immovable projecting of the nail sets. The effect is accurate.

BRIEF DESCRIPTION OF THE DRAWINGS

FIG. 5: The structure of the nail set in front portion;

FIG. 6: The structure of the nail set in rear portion;

FIG. 7: The structure of the cover of sole;

FIG. 8: Sectional view of the structure of the invention (projecting state of the nails)

DESCRIPTION OF THE PREFERRED EMBODIMENTS

Figure 1:
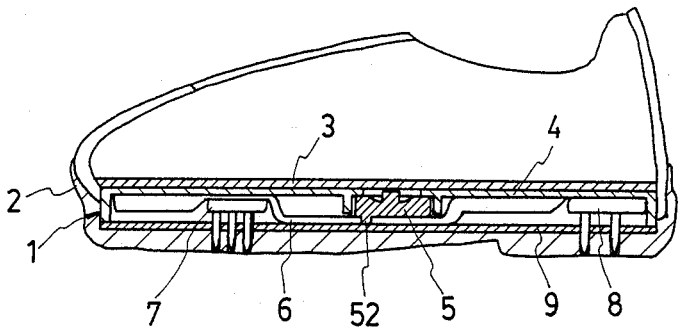
FIG. 1: Sectional view of the structure of the invention (retracted state of the nails)

The shoes of this invention provide the probability of quick and accurate change, and the range of applications is great. Clearly, to change the use by means of a switching device only without requiring a tool, is quite practical. The detailed structure of the shoes in this invention is given as follows:

The main structure of the invention in this case is to install box 1 in the sole. The box is inserted into the rubber layer 2 of the sole and insole 3 is placed on top of the box. When it is required to change the use, the insole 3 is taken off and the key is turned on box 1.

The above box 1 includes body 4, switching device 5, moving board 6, nail sets 7 and 8 and cover of the sole 9.

FIG. 1 is the sectional view of the combination of the fittings of the shoes of this invention with the nail sets 7 and 8 without projecting. It shows the fundamental mutual relations among the fittings of the structure of the shoes.

Figure 2:
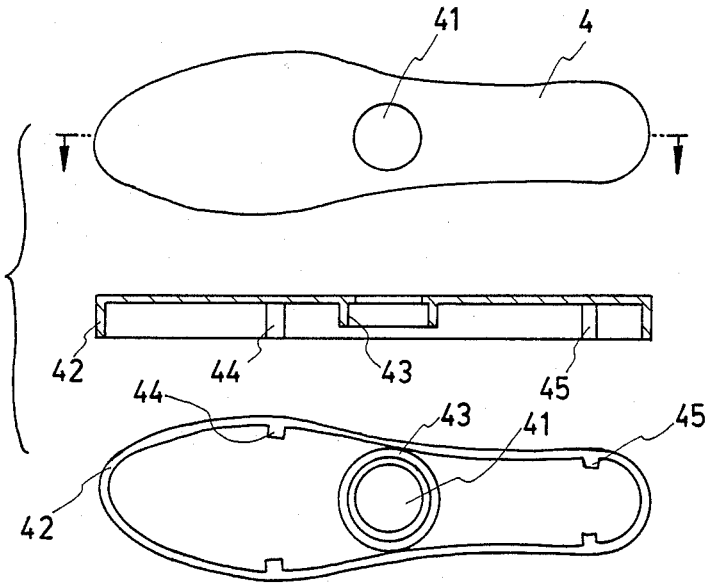
FIG. 2: The structure of the body of the box.

FIG. 2 shows that the shape of the body 4 of box 1 corresponds to that of the sole and is combined with the sole during manufacture. The insole 3 is placed on top of body 4 and there is hole 41 on top of body 4. The hole permits to turn the switching handle 51 to be projected for operation. The position of hole 41 is in the middle of the top of body 4 to avoid affecting the movement of the foot. Surrounding edge 42 of body 4 is bent downwardly to form a containing space below body 4, and it is used to contain switching device 5, moving board 6 and nail sets 7 and 8. As the figure shows, there is circular trough 43 below circular hole 41 to allow the insertion of circular switching device 5 and to make switching device 5 correspond to the moving board 6 in order that moving board 6 move following the turning of the switching device 5 so that the nail sets 7 and 8 move upwardly and downwardly. There are two pairs of convex walls 44 and 45 on appropriate positions of the surrounding edge 42 to confine the movement of nail sets 7 and 8 on fixed positions; in addition, the lower part of surrounding edge 42 is combined with the cover of the sole 9 so that the above parts remain fixed in their respective positions (to be described later).

Figure 3:
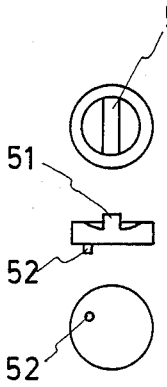
FIG. 3: The structure of the switching device.

FIG. 3 shows the structure of the switching device 5. It is a disk with a convex switching handle 51, and there is the convex pin 52 in the appropriate position in the lower part; the two sides of switching handle 51 are smaller than switching device 5 so that it may project of the circular hole 41 and turn steadily within the circular hole 41. The turning of the switching handle 51 brings about the movement of the convex pin 52 and the movement of the turning of switching handle 51 causes moving board 6 to move straight due to the matching of convex pin 52 and the trough hole 61 in moving board 6.

Figure 4:
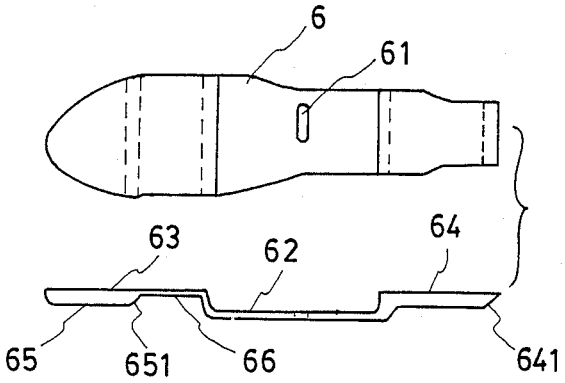
FIG. 4: The structure of the moving board.

FIG. 4 shows the structure of moving board 6. There is trough hole 61 in the middle position 62 to be matched with the above convex pin 52. The front section 63 matches with the nail set 7 and convex wall 44; the rear section 64 matches with the nail set 8 and convex wall 45. The middle section 62 of the above structure is of concave shape with the depth of hollowness being the depth of the circular trough 43 while the thickness and the depth of hollowness are slightly smaller than the internal depth of the surrounding edge 42 in the middle portion so that the moving board 6 does not move up and down. On the other hand, the distance between the front and rear is exactly sufficient to permit moving board 6 to move forward and backward fully. The front section 63 of the moving board 6 has a front portion 65 and rear portion 66, the rear portion 66 providing the space to contain nail set 7 while it is inserted when moving board 6 shifts backwardly. Due to the tilting angle 651 of front portion 65, the thicker front portion 65 holds nail set 7 tightly in the convex position as shown in FIG. 8; the shape of the above front portion 65 is restricted to correspond to the distance of a pair of convex walls 44.

Tail 641 of the section 64 is also of the shape of a wedge to be inserted into the upper portion of nail set 8 in order that the nail set 8 projects outwardly and is held tightly in convex shape. The length of the above sets have already been determined on manufacturing in accordance with the requirements.

FIG. 5 is the structure of nail set 7 including board 71 and some pins 72 fixed on board 71. The board 71 is slightly smaller than the internal edge of body 4 in the front of convex wall 44, and its front tilts upwardly to form inverse angle 73 to correspond to tilting angle 651, and when it retracts, due to the restriction of convex wall 44, it could only move downwardly to form the tight holding state with the front portion 65.

FIG. 6 is the structure of nail set 8 including board 81, some pins 82 fixed on body 81. The front upper portion of board 81 forms inverse angle 83 and the middle portion of the two sides of body 81 forms concave trough 84. Due to the matching of concave trough 84 and convex wall 45, the above nail set could only move up and down. The insertion into the upper portion of board 81 of the latter section 64 of the moving board 6 determines the projecting of nail 82.

FIG. 7 is the structure of cover 9 of the sole. The shape of the plane is the same as that of body 4 to be adhered tightly on the lower portion of surrounding edge 42. There are holes 91 and 92 on the same positions of pins 72 and 82 of nail sets 7 and 8 to accommodate the elastic nails 72 and 82. There are also holes on appropriate positions of the insole to be adhered beneath cover 9 of the sole to be used for the projection or retraction of nails 72 and 82.

FIG. 8 is another state of the sectional view of the structure of the shoes. It shows the condition of projection of nails 72 and 82 (FIG. 1 shows the condition of retraction).

Due to the fact that the soles are generally of elastic material, while nails 72 and 82 retract back, they are clamped by the sole and may not project easily.

The circular measure, softness and hardness (the application of material) should cope with the above features on practical manufacture.

I claim:

1. A shoe having nails of elastic material in the sole capable of projecting from the sole and retracting which comprises an outer sole (2), and insole (3), a box (1) between said insole and said sole, said box comprising a cover (9), a body (4), having edge (42) bent downwardly to form a chamber for containing switching device (5), a moving board (6), a set of front nails (7) and a set of rear nails (8), said body (4) having a hole (41) in the middle thereof, said switching device being inserted within said hole, said board (6) having a hole (61), said edge (42) having two pairs of walls (44, 45) to confine said sets of nail (7, 8) to fixed positions, said switching device having a handle (51) and a convex pin (52) of size corresponding to said hole (61), whereby when said switching handle is turned, said convex pin is inserted in said hole (61), said board having a concave portion (62) in the middle thereof, a front portion (63) and a rear portion (64) of greater thickness than said middle portion, the distance between said front portion (63) and said rear portion (64) being predetermined to allow said board to move forwardly and rearwardly, said front portion (63) having an end part (65) thicker than the part (66) adjacent said concave portion (62), said set of nails (7) being located under said part (66) and said convex wall (44) when the set of nails (7) is in the retracted position, said set of nails (8) being located under said rear portion (64) when the set of nails is in retracted position, said set of nails (7) having and upper board (71), said set of nails (8) having an upper board (81), the end thicker part (65) of said moving board being inserted into said upper board (71) when the set of nails (7) is in the projected position, said rear portion (64) being inserted into said board (81) when the set of nails (8) is in the projected position.

2. The shoe according to claim 1, wherein body (4) has an internal edge and said board (71) is smaller than said internal edge and the front of said board forms an angle (73), said portion (65) of said moving board forms an angle at the rear end thereof corresponding to said angle (73).

3. The shoe according to claim 1 wherein said board (81) forms an angle (83) at the front thereof and forms a concave portion (84) in the middle portion, said concave portion (84) engaging with said convex wall (45).

* * * * *